US010336110B2

(12) United States Patent
Ishizawa et al.

(10) Patent No.: US 10,336,110 B2
(45) Date of Patent: Jul. 2, 2019

(54) LIQUID EJECTION APPARATUS AND CARTRIDGE

(71) Applicant: SEIKO EPSON CORPORATION, Tokyo (JP)

(72) Inventors: Taku Ishizawa, Matsumoto (JP); Shun Oya, Kiso-Machi (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/646,674

(22) Filed: Jul. 11, 2017

(65) Prior Publication Data

US 2018/0015752 A1 Jan. 18, 2018

(30) Foreign Application Priority Data

Jul. 12, 2016 (JP) ..... 2016-137367

(51) Int. Cl.

| | |
|---|---|
| ***B41J 25/34*** | (2006.01) |
| ***B41J 2/14*** | (2006.01) |
| ***B41J 2/175*** | (2006.01) |
| ***B41J 29/02*** | (2006.01) |
| ***B41J 29/13*** | (2006.01) |

(52) U.S. Cl.

CPC ..... *B41J 25/34* (2013.01); *B41J 2/1433* (2013.01); *B41J 2/1752* (2013.01); *B41J 2/1753* (2013.01); *B41J 2/17513* (2013.01); *B41J 2/17553* (2013.01); *B41J 2/17556* (2013.01); *B41J 29/023* (2013.01); *B41J 29/13* (2013.01)

(58) Field of Classification Search

CPC .. B41J 2/1752; B41J 2/17553; B41J 2/17513; B41J 2/1753; B41J 2/1433; B41J 25/34; B41J 2/17556; B41J 2/17503; B41J 29/13; B41J 29/02; B41J 29/023

USPC ..... 347/20, 37, 40, 47, 85, 86

See application file for complete search history.

(56) References Cited

U.S. PATENT DOCUMENTS

| | | | | |
|---|---|---|---|---|
| 8,894,045 | B2 | 11/2014 | Mizutani et al. | |
| 2004/0076447 | A1* | 4/2004 | Matsuo | B41J 2/17513 399/110 |
| 2013/0194354 | A1* | 8/2013 | Petruchik | B41J 2/17513 347/85 |
| 2014/0009540 | A1 | 1/2014 | Matsuzaki et al. | |

FOREIGN PATENT DOCUMENTS

| | | | |
|---|---|---|---|
| JP | 2011-207067 | A | 10/2011 |
| JP | 2014-028499 | A | 2/2014 |

* cited by examiner

*Primary Examiner* — Jannelle M Lebron
(74) *Attorney, Agent, or Firm* — Foley & Lardner LLP

(57) ABSTRACT

The liquid ejection apparatus includes: a liquid ejection head; a carriage that moves in the X direction; a supply roller that is provided at a position closer to a side of the carriage in the −Y direction than to a side thereof in the +Y direction; and a discharge roller that is provided at a position closer to the side of the carriage in the +Y direction than to the side thereof in the −Y direction. A plurality of cartridge slots are provided in the bottom of the carriage on a side in the +Z direction. The plurality of cartridge slots are arranged in the Y direction. The liquid ejection head is provided in the bottom of the carriage on a side in the −Z direction, at a position between the supply roller and the discharge roller, the position being closer to the supply roller than to the discharge roller.

7 Claims, 17 Drawing Sheets

LIQUID EJECTION APPARATUS AND CARTRIDGE

CROSS REFERENCE TO RELATED APPLICATION

This application claims priority to Japanese Application No. 2016-137367 filed on Jul. 12, 2016. The entire disclosure of this Japanese application is expressly incorporated by reference herein.

BACKGROUND

1. Technical Field

The present invention relates to liquid ejection apparatuses and cartridges.

2. Related Art

Hitherto, cartridges for supplying a liquid to liquid ejection apparatuses, such as printers, are widely used. For example, in a printer described in JP-A-2014-28499, a plurality of cartridges are mounted in a carriage that moves back and forth in a main scanning direction.

In JP-A-2014-28499, a plurality of cartridges are arranged in a main scanning direction on a carriage. For this reason, there may be cases where the size of the carriage in the main scanning direction increases, and the width of the liquid ejection apparatus also increases accordingly. In addition, regarding liquid ejection apparatuses, there is a need to improve the accuracy of the position on a medium at which the liquid lands. When, for example, a liquid ejection apparatus is carried, if the orientation of the liquid ejection apparatus is changed while cartridges are attached thereto, liquid may leak out from nozzles of the cartridges.

SUMMARY

The invention has been made to solve at least some of the foregoing problems, and can be implemented in the following modes.

(1) In a first mode of the invention, a liquid ejection apparatus is provided. This liquid ejection apparatus includes: a liquid ejection head having a nozzle group for ejecting liquid onto a medium; a carriage that has a bottom formed parallel to the X direction and the Y direction and moves in the X direction; a supply roller that is provided at a position closer to a side of the carriage in the −Y direction than to a side thereof in the +Y direction, and conveys the medium in the +Y direction; and a discharge roller that is provided at a position closer to the side of the carriage in the +Y direction than to the side thereof in the −Y direction, and conveys the medium in the +Y direction. A plurality of cartridge slots to which a plurality of cartridges are attached are provided in the bottom of the carriage on a side in the +Z direction. The plurality of cartridge slots are arranged in the Y direction. The liquid ejection head is provided in the bottom of the carriage on a side in the −Z direction, at a position between the supply roller and the discharge roller, the position being closer to the supply roller than to the discharge roller. In the liquid ejection apparatus in this mode, the plurality of cartridges are attached to be arranged in the Y direction. Accordingly, the width of the liquid ejection apparatus (length in the X direction) can be reduced. Since the liquid ejection head is provided closer to the supply roller than to the discharge roller, the accuracy of the position on the medium at which the liquid lands can be improved.

(2) In the liquid ejection apparatus in the above mode, the nozzle group may include a plurality of nozzle rows. The nozzle rows may be constituted by a plurality of nozzles that eject one type of liquid supplied from one of the plurality of cartridges. The plurality of nozzles constituting the nozzle rows may be arranged in the Y direction. The plurality of nozzle rows may be arranged in the X direction. In the liquid ejection apparatus in this mode, the size of the entire nozzle group in the X direction can be reduced compared with the case where the plurality of nozzles are not arranged parallel to the Y direction, or the case where the plurality of nozzle rows are arranged obliquely to the X direction. Accordingly, the width of the liquid ejection apparatus can be reduced.

(3) In a second mode of the invention, a cartridge to be attached to the liquid ejection apparatus in any of the above modes is provided. This cartridge includes: a liquid containing chamber; and a negative pressure generating mechanism that generates a predetermined negative pressure in the liquid containing chamber. The negative pressure is set so that a liquid pressure applied to a nozzle located at an end in the −Y direction in the nozzle group is lower than the atmospheric pressure when the liquid ejection apparatus is caused to assume an orientation in which a side of the liquid ejection apparatus in the −Y direction is lower, relative to the gravity direction, than a side thereof in the +Y direction. With the cartridge in this mode, it is possible to suppress leakage of the liquid from the nozzles when the liquid ejection apparatus is tilted.

(4) In the cartridge in the above mode, the negative pressure may be set so that a liquid pressure applied to a nozzle located at an end in the −Y direction in the nozzle group is lower than the atmospheric pressure when the liquid ejection apparatus is caused to assume an orientation in which a side of the liquid ejection apparatus in the −Y direction is lower, relative to the gravity direction, than a side thereof on the +Y direction before the liquid in the liquid containing chamber starts to be consumed. With the cartridge in this mode, it is possible to more effectively suppress leakage of the liquid from the nozzles when the liquid ejection apparatus is tilted.

(5) In the cartridge in the above mode, the negative pressure generating mechanism may be constituted by a spring or foam. With the cartridge in this mode, a desired negative pressure can be readily obtained.

The invention can also be implemented in various modes other than the above modes of the liquid ejection apparatus and cartridge. For example, the invention can be implemented in the modes of a liquid supply system that includes a cartridge and a liquid ejection apparatus, a printer, and the like.

BRIEF DESCRIPTION OF THE DRAWINGS

The invention will be described with reference to the accompanying drawings, wherein like numbers reference like elements.

DESCRIPTION OF EXEMPLARY EMBODIMENTS

A. Embodiment

Figure 1:
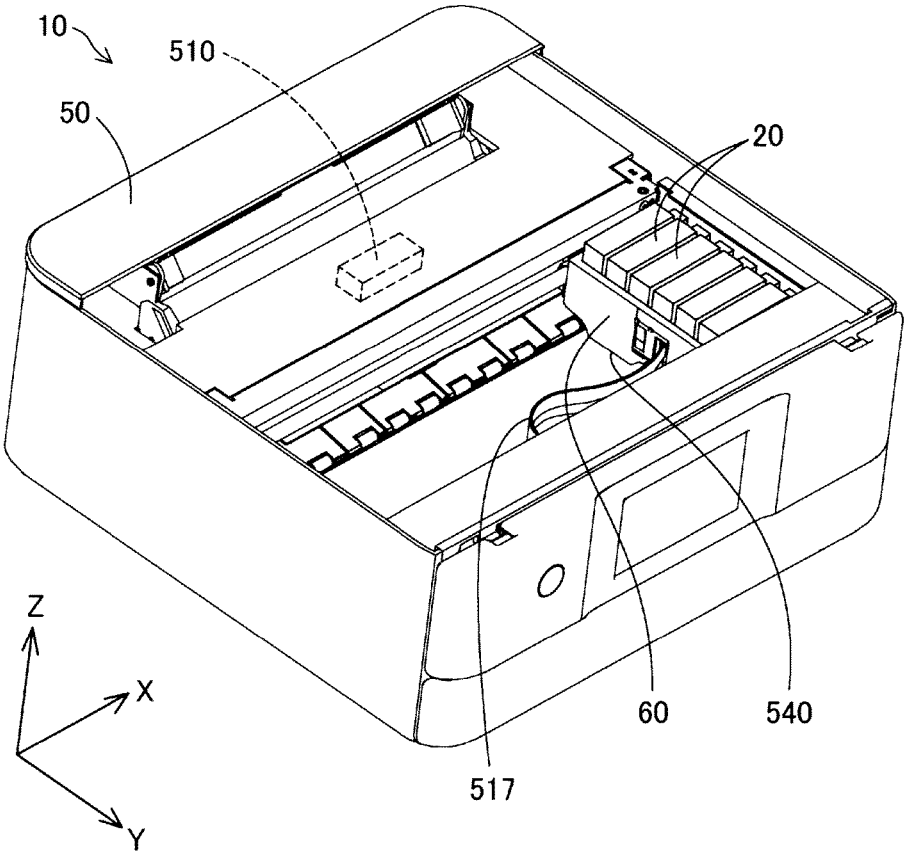
FIG. 1 is a perspective view showing a schematic configuration of a liquid supply system.

FIG. 1 is a perspective view showing a schematic configuration of a liquid supply system 10. In FIG. 1, three orthogonal directions are shown. It is assumed that these three directions are an X direction, a Y direction, and a Z direction. These directions shown in FIG. 1 correspond to directions shown in the other diagrams. In the following description, it is assumed that the positive X direction and negative X direction respectively are a +X direction and a −X direction, the positive Y direction and negative Y direction respectively are a +Y direction and a −Y direction, and the positive Z direction and negative Z direction respectively are a +Z direction and a −Z direction. The liquid supply system 10 includes cartridges 20 and a printer 50, which serves as a liquid ejection apparatus. In the liquid supply system 10, the cartridges 20 can be attached to a carriage 60 in the printer 50 by a user.

The cartridges 20 in the liquid supply system 10 contain ink, which serves as a printing material (liquid). The ink contained in the cartridges 20 is supplied to a liquid ejection head 540 via later-described liquid supply portions and liquid introducing portions. In this embodiment, a plurality of cartridges 20 are removably attached to the carriage 60 in the printer 50. In this embodiment, six types of cartridges 20 corresponding to six ink colors (black, yellow, magenta, light magenta, cyan, and light cyan) are attached one by one, i.e., a total of six cartridges 20 are attached to the carriage 60.

In another embodiment, the number of cartridges to be attached to the carriage 60 may be less than six, or may be more than six. In another embodiment, the number of ink colors in the cartridges 20 may be less than six, or may be more than six. In another embodiment, two or more cartridges 20 may be attached, corresponding to one ink color, to the carriage 60.

The printer 50 is a small inkjet printer for personal use. The printer 50 includes the carriage 60 and a control unit 510. The carriage 60 includes the liquid ejection head 540. The printer 50 causes the ink to flow into the liquid ejection head 540 from the cartridges 20 attached to the carriage 60 via the later-described liquid introducing portions, and ejects the ink from the liquid ejection head 540 onto a print medium, such as paper or a label. Thus, characters, diagrams, images, or the like are printed on the print medium using the liquid ejection head 540.

The control unit 510 in the printer 50 controls each portion of the printer 50. The carriage 60 in the printer 50 is configured to be able to relatively move the liquid ejection head 540 with respect to the print medium. The liquid ejection head 540 in the printer 50 includes an ink ejection mechanism for ejecting (discharging) the ink contained in the cartridges 20 toward the print medium. The control unit 510 and the carriage 60 are electrically connected via a flexible cable 517. The ink ejection mechanism in the liquid ejection head 540 operates based on a control signal from the control unit 510.

The type of the printer 50 in which the cartridges 20 are attached onto the carriage 60 for moving the liquid ejection head 540 is also called an "on-carriage type". In another embodiment, the ink may be supplied from cartridges 20, which are arranged in a portion other than the carriage 60, to the liquid ejection head 540 in the carriage 60 via flexible tubes or the like. This type of printer is also called an "off-carriage type".

In this embodiment, the printer 50 includes a main scan feeding mechanism and a sub-scan feeding mechanism for relatively moving the carriage 60 and the print medium to implement printing on the print medium. The main scan feeding mechanism in the printer 50 includes a motor and a drive belt. The main scan feeding mechanism moves the carriage 60 back and forth in the main scanning direction by transmitting power generated by the motor to the carriage 60 via the drive belt. The sub-scan feeding mechanism in the printer 50 includes a motor, a supply roller, and a discharge roller. The sub-scan feeding mechanism conveys the print medium in the sub-scanning direction, which is perpendicular to the main scanning direction, by driving these rollers using the motor. The motor in the main scan feeding mechanism and the motor in the sub-scan feeding mechanism operate based on a control signal from the control unit 510.

In this embodiment, in a use state (also referred to as a "use orientation") of the liquid supply system 10, the Y direction is a direction parallel to the sub-scanning direction (front-rear direction) in which the print medium is conveyed. The X direction is a direction parallel to the main scanning direction (left-right direction) in which the carriage 60 is moved back and forth. The Z direction is a direction parallel to the gravity direction (up-down direction). Note that the use state of the liquid supply system 10 refers to the state of the liquid supply system 10 that is installed on a horizontal surface. In this embodiment, the horizontal surface refers to a surface that is parallel to the X direction and the Y direction (XY plane).

In this embodiment, the +Y direction is the sub-scanning direction (forward direction), and the −Y direction is the opposite direction (rearward direction). The +Z direction is the direction from the lower side toward the upper side in the gravity direction (upward direction), and the −Z direction is the opposite direction (downward direction). In this embodiment, the side in the +Y direction (front side) corresponds to the front face of the liquid supply system 10. In this embodiment, the +X direction is the direction from the left side face toward the right side face of the liquid supply system 10 (rightward direction), and the −X direction is the opposite direction (leftward direction).

In this embodiment, the direction in which the plurality of cartridges 20 attached to the carriage 60 are arranged is the Y direction. That is to say, in the carriage 60, the plurality of cartridges 20 are arranged in a direction (Y direction) perpendicular to the direction (X direction) in which the carriage 60 moves. Thus, in this embodiment, since the plurality of cartridges 20 are attached so as to be arranged in the Y direction, the width of the printer 50 (length in the X direction) can be reduced.

Figure 2:
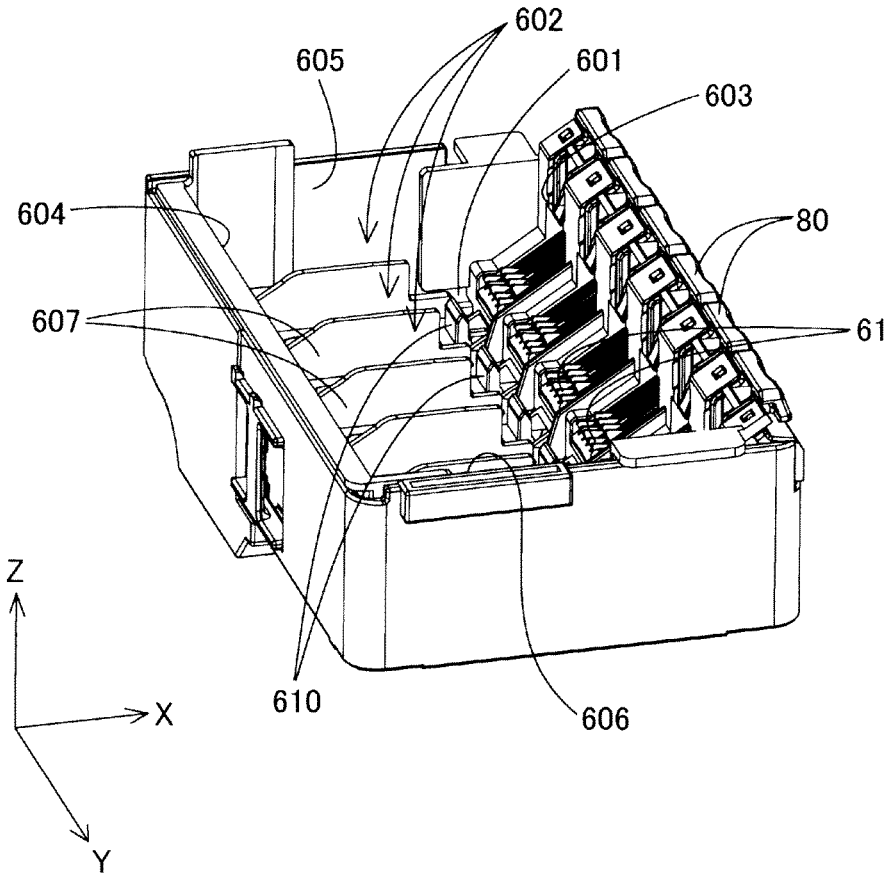
FIG. 2 is a first perspective view of a carriage.
Figure 3:
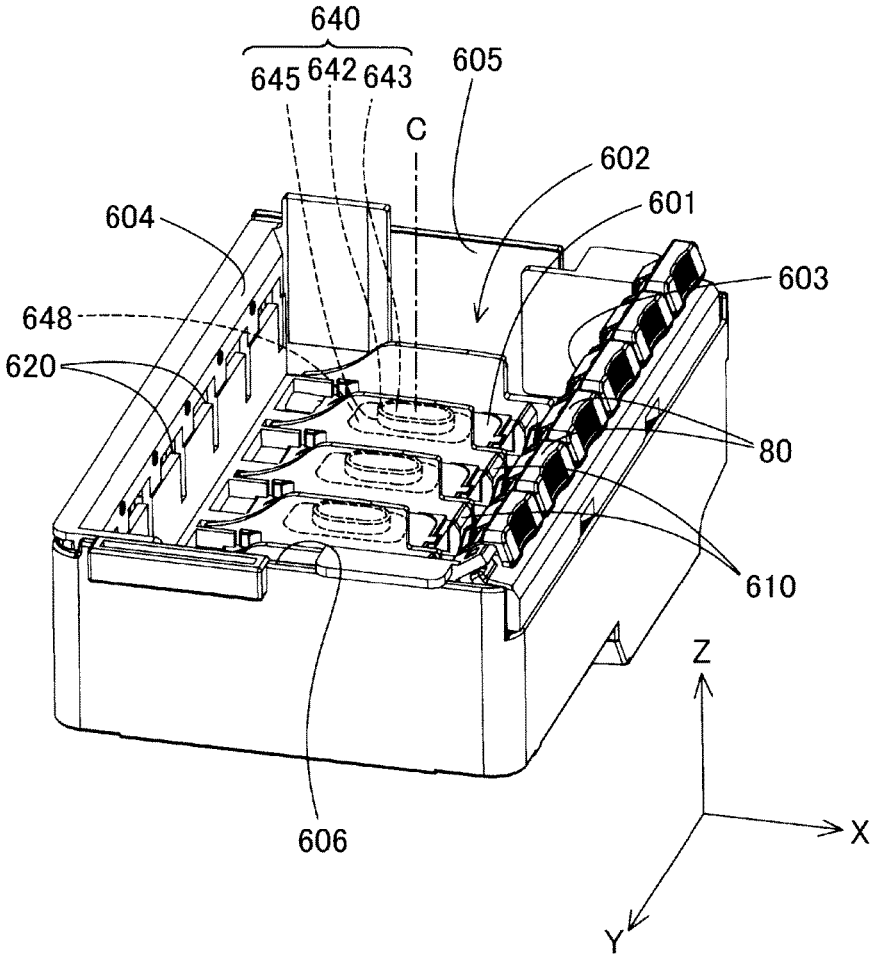
FIG. 3 is a second perspective view of the carriage.
Figure 4:
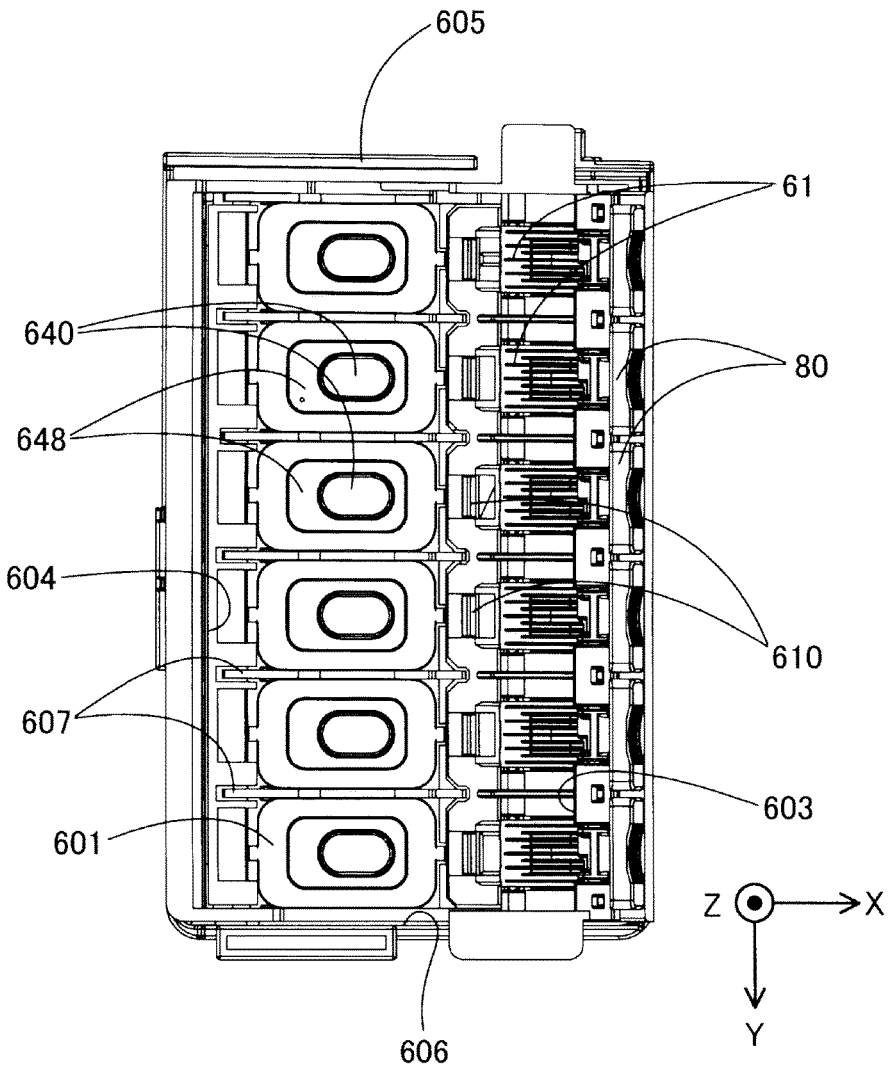
FIG. 4 is a plan view of the carriage as viewed from the side in a +Z direction.

FIG. 2 is a first perspective view of the carriage 60. FIG. 3 is a second perspective view of the carriage 60. FIG. 4 is a plan view of the carriage 60 as viewed from the side in the +Z direction.

As shown in FIGS. 2 to 4, the carriage 60 has a bottom 601 and walls 603, 604, 605, and 606. The cartridges 20 are accommodated in a recessed portion that is formed by the bottom 601 and the four walls. The bottom 601 is formed parallel to the X direction and Y direction. A plurality of cartridge slots 602, to which the plurality of cartridges 20 are attached, are provided in the bottom 601 on the side in the +Z direction. The plurality of cartridge slots 602 are arranged in the Y direction. The cartridge slots 602 are spaces partitioned by partition walls 607. The partition walls 607 function as guides for inserting the cartridges 20 into the cartridge slots 602. In the carriage 60, a liquid introducing portion 640, a seal member 648, an electrode portion 61, a lever 80, a positioning projection 610, and an apparatus restricting portion 620 (FIG. 3) are provided for each cartridge slot 602. Each cartridge slot 602 is open in one side face (side face located in the +Z direction; upper face). A cartridge 20 is attached to and detached from the carriage 60 via the open side face (upper face). The liquid introducing portion 640 is provided so as to be sandwiched by two partition walls 607.

The positioning projection 610 is a substantially rectangular-parallelepiped member that projects in the +Z direction from the bottom 601. The positioning projection 610 is inserted into a positioning portion provided in the cartridge 20. To facilitate the insertion into the positioning portion of the cartridge 20, faces in a leading end portion of the positioning projection 610 on the side in the +X direction and the side in the −X direction tilt relative to each other so as to be closer to each other on the leading end side.

The cartridge 20 is locked by the lever 80 and the apparatus restricting portion 620, and is attached to the carriage 60 as a result of the later-described liquid supply portion being connected to the liquid introducing portion 640. This state will also be called "a state where the cartridge 20 has been attached to the carriage 60" or "an attached state". In the attached state, a terminal group provided in a later-described circuit board on the cartridge 20 is electrically connected to the electrode portion 61. Thus, various kinds of information are conveyed between the cartridge 20 and the printer 50.

When in the attached state, as a result of the liquid introducing portion 640 being connected to the liquid supply portion of the cartridge 20, the ink contained in the cartridge 20 is caused to flow into the liquid ejection head 540 that is in communication with the liquid introducing portion 640. The liquid introducing portion 640 is substantially tubular, and has a leading end portion 642, which is located on the side in the +Z direction, and a base end portion 645, which is located on the side in the −Z direction. The base end portion 645 is provided in the bottom 601. The leading end portion 642 is connected to the liquid supply portion of the cartridge 20. An apparatus filter 643 is provided in the leading end portion 642. The ink flows into the liquid introducing portion 640 from the liquid supply portion of the cartridge 20 through the apparatus filter 643. The apparatus filter 643 is made of a porous member such as a metal mesh, metal non-woven fabric, or a resin filter, for example. The center axis C of the liquid introducing portion 640 is parallel to the Z direction. The direction from the base end portion 645 toward the leading end portion 642 along the center axis C is the +Z direction.

As shown in FIGS. 3 and 4, a seal member 648 that surrounds the liquid introducing portion 640 is provided around the base end portion 645 of the liquid introducing portion 640. The seal member 648 is made of elastic rubber, for example. When in the attached state, the seal member 648 seals the periphery of the liquid supply portion of the cartridge 20. Thus, the seal member 648 prevents the ink from leaking from the liquid supply portion to the surrounding area. When in the attached state, the seal member 648 applies a biasing force, which contains a component in the +Z direction, to the cartridge 20.

Figure 5:
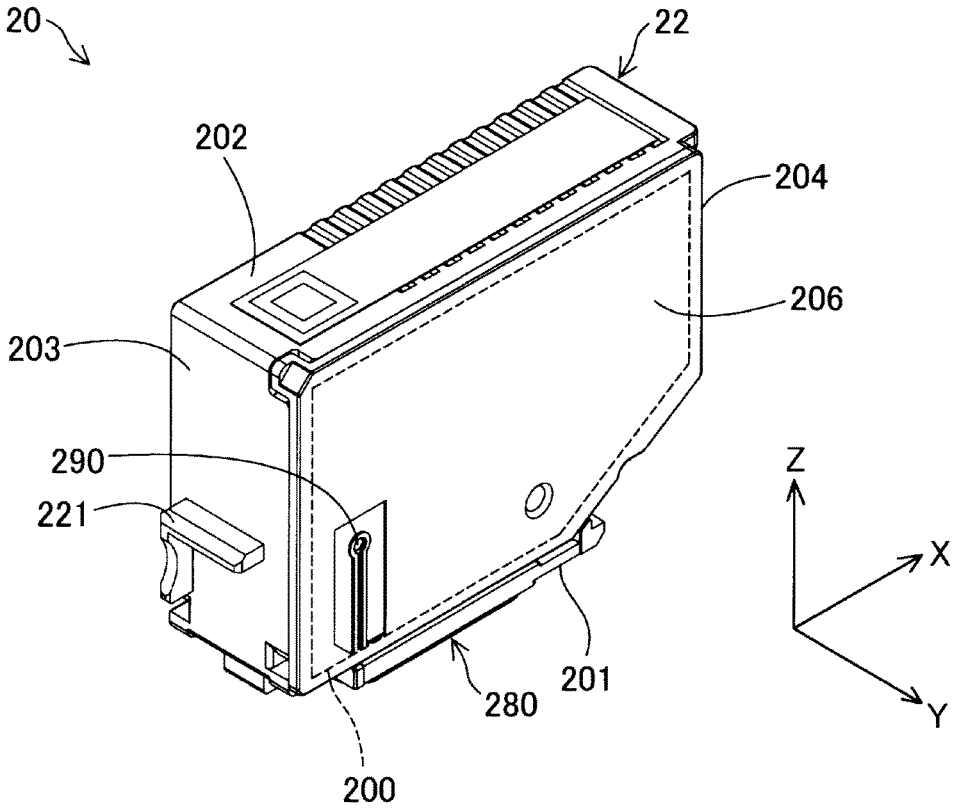
FIG. 5 is a first perspective view showing an external appearance of a cartridge.
Figure 6:
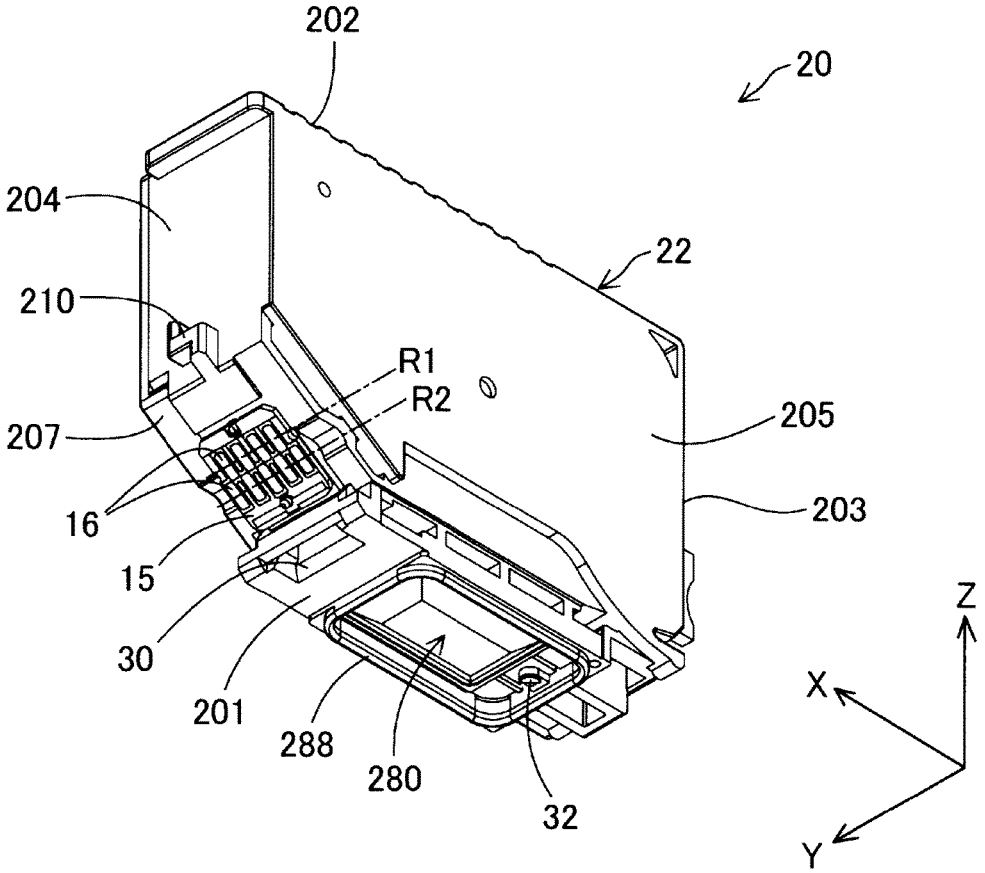
FIG. 6 is a second perspective view showing the external appearance of the cartridge.
Figure 7:
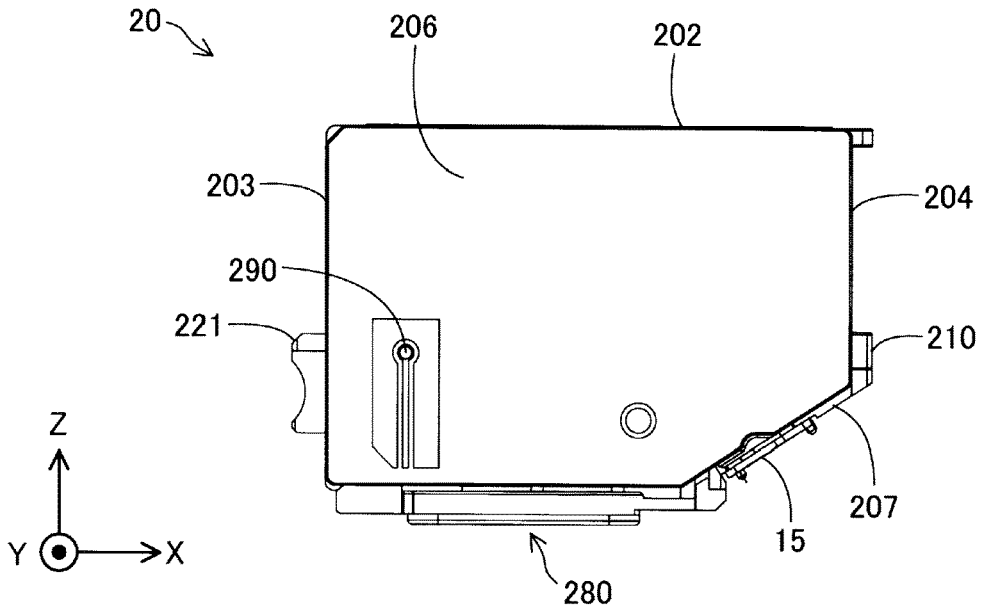
FIG. 7 is an elevational view of the cartridge.
Figure 8:
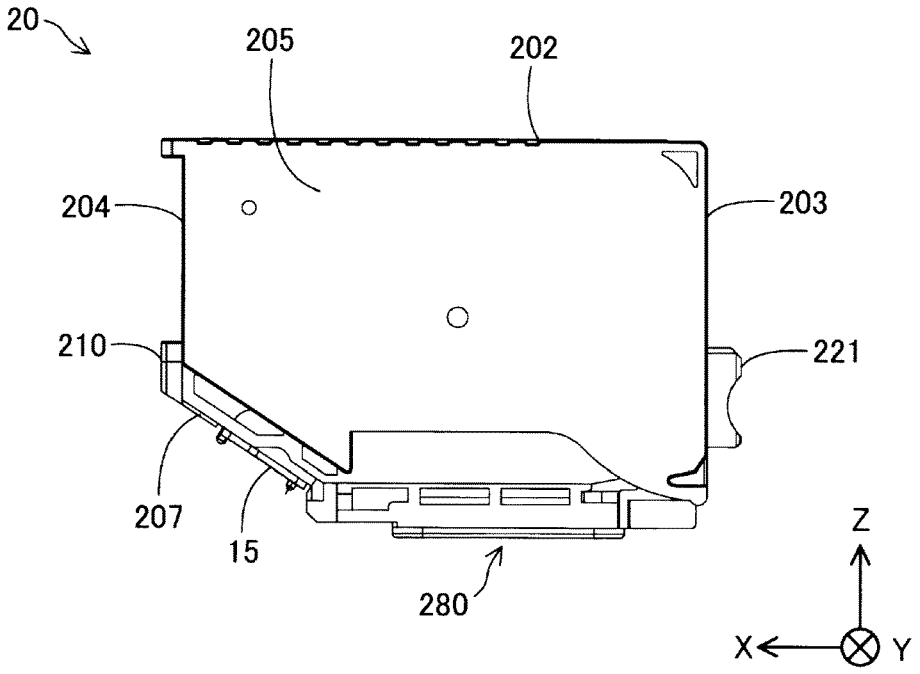
FIG. 8 is a rear view of the cartridge.
Figure 9:
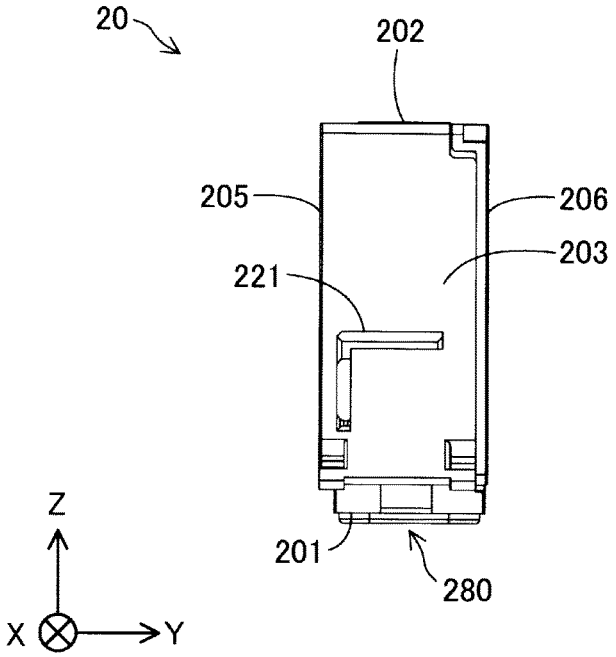
FIG. 9 is a left side view of the cartridge.
Figure 10:
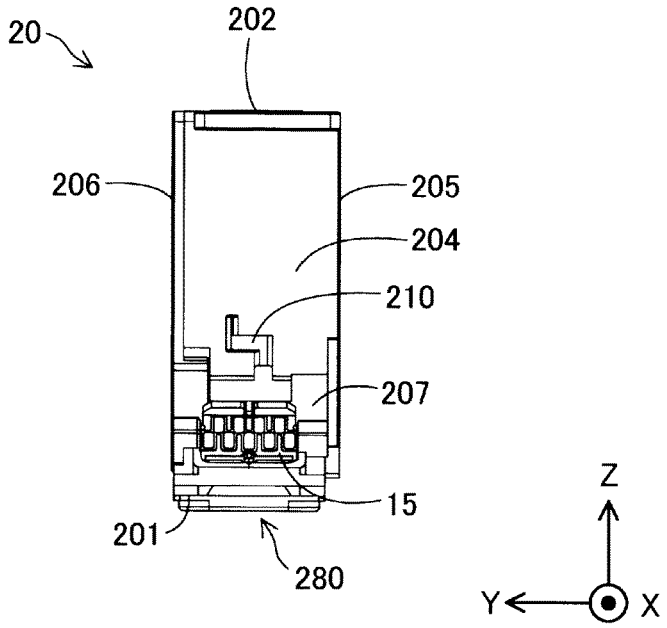
FIG. 10 is a right side view of the cartridge.
Figure 11:
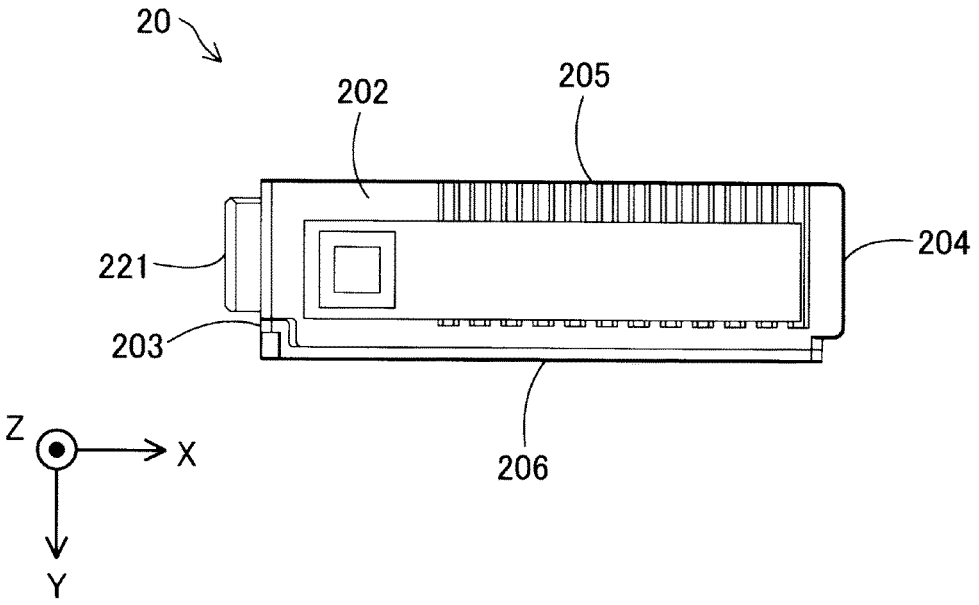
FIG. 11 is a plan view of the cartridge.
Figure 12:
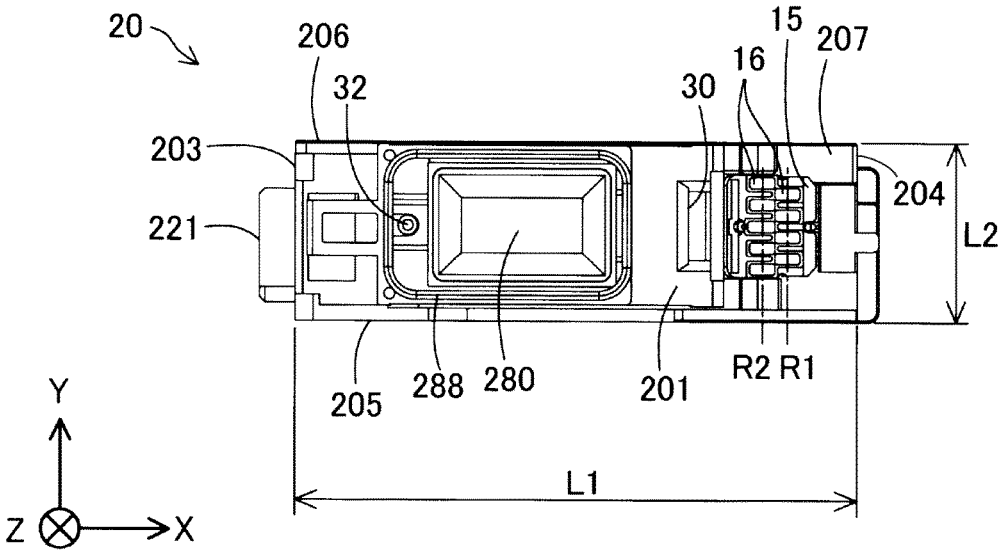
FIG. 12 is a bottom view of the cartridge.

FIG. 5 is a first perspective view showing an external appearance of the cartridge 20. FIG. 6 is a second perspective view showing the external appearance of the cartridge 20. FIG. 7 is an elevational view of the cartridge 20. FIG. 8 is a rear view of the cartridge 20. FIG. 9 is a left side view of the cartridge 20. FIG. 10 is a right side view of the cartridge 20. FIG. 11 is a plan view of the cartridge 20. FIG. 12 is a bottom view of the cartridge 20. The cartridge 20 according to this embodiment is of a so-called semi-sealed type, in which outside air is intermittently introduced into the liquid containing chamber 200 as the ink is consumed.

As shown in FIGS. 5 and 6, each cartridge 20 has seven walls 201 to 207. These walls constitute a substantially rectangular-parallelepiped outer shell 22 of the cartridge 20. The seven walls are a first wall 201 (bottom wall 201), a second wall 202 (upper wall 202), a third wall 203 (one end wall 203), a fourth wall 204 (the other end wall 204), a fifth wall 205 (one side wall 205), a sixth wall 206 (the other side wall 206), and a seventh wall 207 (inclined wall 207). These seven walls 201 to 207 surround the liquid containing chamber 200 that is in communication with the liquid supply portion 280.

In the following description, two walls "crossing each other" or "intersecting each other" means any of a state where the two walls are connected to and cross each other, a state where one wall, being extended, crosses another wall, and a state where the two walls cross each other when both are extended. Two walls "opposes each other" means both the case where nothing is present between the two walls and the case where something is present therebetween.

The outer surface of each of the walls 201 to 207 is substantially flat. "Being substantially flat" includes the case where an entire face is completely flat and the case where a part of the face is uneven. That is to say, it encompasses the case where, even if a part of the face is more or less uneven, a face and the wall constituting the outer shell 22 of the cartridge 20 can be recognized as being so. The outer shape of each of the first wall 201 to the seventh wall 207 in a plan view is rectangular, excluding the fifth wall 205 and the sixth wall 206. In this embodiment, the first wall 201 to the seventh wall 207 may be outer surfaces of an assembly that is obtained by assembling a plurality of members. In this embodiment, the first wall 201 to the seventh wall 207 each have a plate shape. In another embodiment, some of the first wall 201 to the seventh wall 207 may be made of a film (thin film) member. The first wall 201 to the seventh wall 207 are made of synthetic resin, such as polyacetal (POM), for example.

As shown in FIGS. 5 and 6, the first wall 201 and the second wall 202 are walls parallel to the X direction and Y direction. The second wall 202 opposes the first wall 201. That is to say, the first wall 201 and the second wall 202 oppose each other in the Z direction. The first wall 201 is located on the side in the −Z direction, and the second wall 202 is located on the side in the +Z direction. The first wall 201 and the second wall 202 are in a positional relationship in which they cross the third wall 203, the fourth wall 204, the fifth wall 205, and the sixth wall 206. In this embodiment, when the cartridge 20 is in the attached state, i.e. is attached to the carriage 60, the first wall 201 constitutes the bottom face of the cartridge 20, and the second wall 202 constitutes the upper face of the cartridge 20. The liquid supply portion 280, a peripheral wall 288, and a positioning portion 30 are provided in the first wall 201 so as to be oriented in the −Z direction.

The third wall 203 and the fourth wall 204 are walls parallel to the Y direction and the Z direction. The third wall 203 and the fourth wall 204 oppose each other in the X direction. The third wall 203 is located on the side in the −X direction, and the fourth wall 204 is located on the side in the +X direction. The third wall 203 intersects the first wall 201 and the second wall 202. The fourth wall 204 intersects the first wall 201 and the second wall 202, and opposes the third wall 203. In this embodiment, when the cartridge 20 is in a state of being attached to the carriage 60, the direction in which the carriage 60 moves is parallel to the direction from the third wall 203 toward the fourth wall 204.

The fifth wall 205 and the sixth wall 206 are walls parallel to the X direction and the Z direction. The fifth wall 205 and the sixth wall 206 oppose each other in the Y direction. The fifth wall 205 intersects the first wall 201, the second wall 202, the third wall 203, and the fourth wall 204. The sixth wall 206 intersects the first wall 201, the second wall 202, the third wall 203, and the fourth wall 204, and opposes the fifth wall 205. As shown in FIG. 5, a vent 290 for introducing air into the cartridge 20 is formed in the sixth wall 206.

As shown in FIG. 6, the seventh wall 207 connects the first wall 201 and the fourth wall 204 to each other. The seventh wall 207 intersects the fifth wall 205 and the sixth wall 206, and is located between the first wall 201 and the fourth wall 204. Contact portions 16, which can come into contact with the electrode portion 61 of the printer 50, are formed in the seventh wall 207. In this embodiment, these contact portions 16 are formed in a substrate 15 that is provided in the seventh wall 207. That is to say, the substrate 15 has a plurality of contact portions 16 that come into contact with the electrode portion 61 provided in the carriage 60 when in the attached state. More specifically, the contact portions 16 form an area in an electrode terminal provided on the surface of the substrate 15, and this area comes into contact with the electrode portion 61. In this embodiment, the plurality of contact portions 16, when viewed from the −Z direction, form a first row R1 and a second row R2 with a given gap therebetween in the X direction. A storage device 18 (FIG. 18) for storing various kinds of information regarding the cartridge 20 is provided on the back face of the substrate 15. For example, information indicating the amount of remaining ink, ink color, and the like is stored in the storage device 18. Upon the electrode portion 61 provided in the carriage 60 coming into contact with the contact portions 16, the control unit 510 included in the printer 50 can read various kinds of information from the storage device 18 included in the cartridge 20 via the flexible cable 517.

As shown in FIG. 6, the positioning portion 30, which is recessed in the +Z direction, is provided at an end of the first wall 201 on the seventh wall 207 side. That is to say, the positioning portion 30 is located between the liquid supply portion 280 arranged in the first wall 201 and the substrate 15 arranged in the seventh wall 207. When in the attached state, the positioning projection 610 provided on the carriage 60 is inserted into and abuts against the positioning portion 30. Thus, the cartridge 20 is positioned within the carriage 60.

As shown in FIGS. 6 and 10, a first cartridge restricting portion 210 (one rib 210), which has a projecting shape, is formed in the fourth wall 204. The first cartridge restricting portion 210 is locked by the lever 80 when in the attached state. As shown in FIGS. 5 and 9, a second cartridge restricting portion 221 (the other rib 221), which has a projecting shape, is formed in the third wall 203. The second cartridge restricting portion 221 is a projection that projects in the direction from the fourth wall 204 toward the third wall 203 and is capable of engaging with the apparatus restricting portion 620 in the carriage 60. When in the attached state, the second cartridge restricting portion 221 is inserted into and locked by the apparatus restricting portion 620, which is a hole formed in a side wall 604 (FIG. 3) among the walls of the carriage 60. That is to say, when in the attached state, the cartridge 20 is locked on both sides in the X direction by the lever 80 and the apparatus restricting portion 620 of the carriage 60. As a result, the cartridge 20 is fixed to the carriage 60. Note that, in the following description, the second cartridge restricting portion 221 will also be called a "projection 221", and the apparatus restricting portion 620 will also be called a "recessed portion 620".

Figure 13:
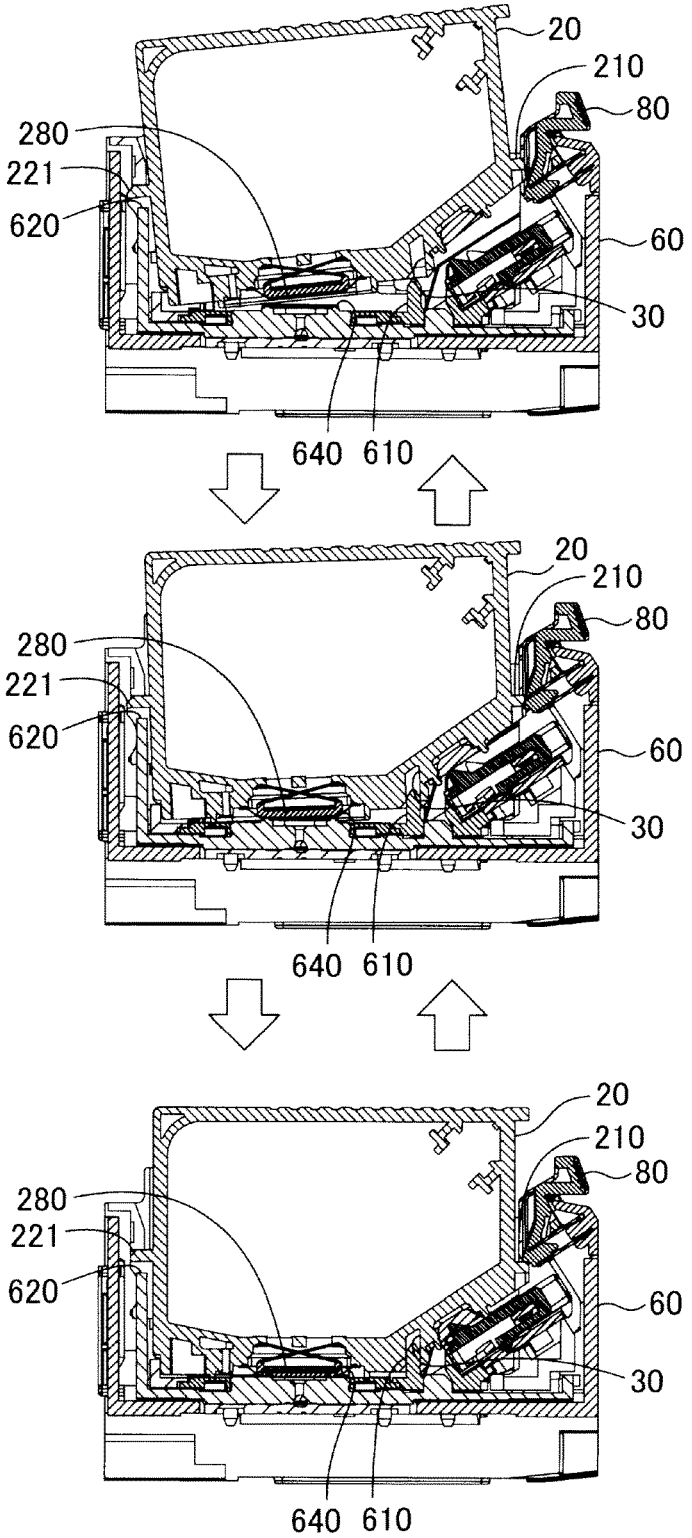
FIG. 13 is a diagram illustrating a state where the cartridge is attached to and detached from the carriage.

FIG. 13 is a diagram illustrating a state where the cartridge 20 is attached to and detached from the carriage 60. When the cartridge 20 is attached to the carriage 60, initially, as shown in the upper part of FIG. 13, the projection 221 is inserted into the recessed portion 620, and the cartridge 20 is rotated (pivoted) around the portion where the apparatus restricting portion 620 comes into contact with the projection 221. Then, as shown in the middle part of FIG. 13, the positioning projection 610 is inserted into the positioning portion 30, and the liquid supply portion 280 comes into contact with the liquid introducing portion 640. Ultimately, as shown in the lower part of FIG. 13, the first cartridge restricting portion 210 is locked by the lever 80, and the cartridge 20 is fixed to the carriage 60. When the cartridge 20 is removed from the carriage 60, in reverse, the locking of the first cartridge restricting portion 210 by the lever 80 is first canceled, and the cartridge 20 is rotated (pivoted) around the portion where the recessed portion 620 comes into contact with the projection 221. Then, the contact between the liquid supply portion 280 and the liquid introducing portion 640 is canceled, and the positioning projection 610 is pulled out of the positioning portion 30. Thus, the cartridge 20 is removed from the carriage 60.

Figure 14:
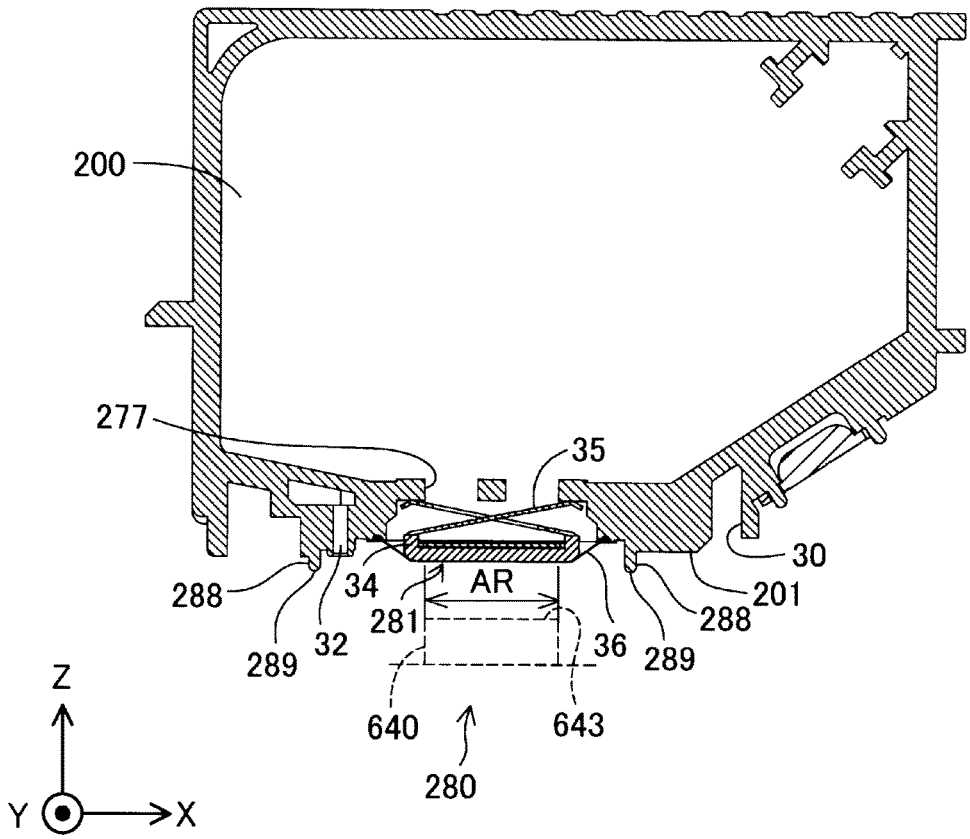
FIG. 14 is a cross-sectional view showing a structure of a liquid supply portion.

FIG. 14 is a cross-sectional view showing a structure of the liquid supply portion 280. The liquid supply portion 280 includes a cartridge filter 36, which comes into contact with the liquid introducing portion 640 to enable the ink to be supplied to the liquid introducing portion 640. The liquid supply portion 280 includes a liquid supply port 281 and an opening 277. The cartridge filter 36 covers the opening 277 from the outer face side of the first wall 201. In this embodiment, the liquid supply portion 280 also includes foam 34 and a flat spring 35.

The liquid supply portion 280 is in communication with the liquid containing chamber 200 via the opening 277. The opening 277 is a hole that passes through the first wall 201 in the Z direction. The cartridge filter 36 is arranged on the side in the −Z direction relative to the opening 277. The cartridge filter 36 is welded to the first wall 201 around the opening 277. The cartridge filter 36 is made of woven fabric, non-woven fabric, or foamed resin (foam), for example. Between the opening 277 and the cartridge filter 36, the flat spring 35, which is made of metal, is arranged on the opening 277 side, and the foam 34 is arranged on the cartridge filter 36 side.

When attaching the cartridge 20 to the carriage 60, the flat spring 35 causes the cartridge filter 36 to come into contact with the apparatus filter 643 while indirectly pressing the cartridge filter 36 against the apparatus filter 643 via the foam 34. The flat spring 35 is formed in a shape that does not interrupt the ink flow from the opening 277 toward the foam 34.

The foam 34 is a porous member that is arranged between the flat spring 35 and the cartridge filter 36. The foam 34 causes the ink supplied from the liquid containing chamber 200 through the opening 277 to disperse toward the cartridge filter 36, thereby supplying the ink. The foam 34 is made of a synthetic resin such as polyethylene terephthalate, for example.

The liquid supply port 281 is an area through which the ink in the liquid containing chamber 200 passes when flowing out of the cartridge 20. Specifically, in this embodiment, the liquid supply port 281 refers to an area AR that comes into contact with the apparatus filter 643 provided in the liquid introducing portion 640 of the carriage 60 and through which the ink flows out, rather than the entire filter area of the cartridge filter 36.

As shown in FIGS. 6, 12, and 14, a peripheral wall 288 is formed in the first wall 201. The peripheral wall 288 surrounds the liquid supply portion 280, projects in the direction from the second wall 202 toward the first wall 201, i.e. the direction in which the liquid supply portion 280 comes into contact with the liquid introducing portion 640, and is capable of abutting against the seal member 648 of the carriage 60. The peripheral wall 288 projects further in the −Z direction than the liquid supply portion 280. When in the attached state, an end 289 of the peripheral wall 288 in the −Z direction abuts against the seal member 648 provided in the bottom 601 of the carriage 60. As a result of this contact, a frictional force is generated between the peripheral wall 288 and the seal member 648 when the carriage 60 moves. Thus, a shift in the position at which the liquid supply portion 280 and the liquid introducing portion 640 are connected is suppressed. Upon the peripheral wall 288 abutting against the seal member 648, the space enclosed by the peripheral wall 288 is substantially closed. In the following description, this space will also be called a "closed space".

A communication port 32 is formed between the peripheral wall 288 and the liquid supply portion 280 in the first wall 201. The communication port 32 is an opening for bringing the closed space within the peripheral wall 288 into communication with the outside. When in the attached state, the pressure difference between the closed space and the outside is kept substantially constant as a result of the communication port 32 bringing the closed space within the peripheral wall 288 into communication with the outside (outside air). Thus, leakage of the ink from the liquid supply portion 280 due to a change in the pressure in the closed space is suppressed.

Figure 15:
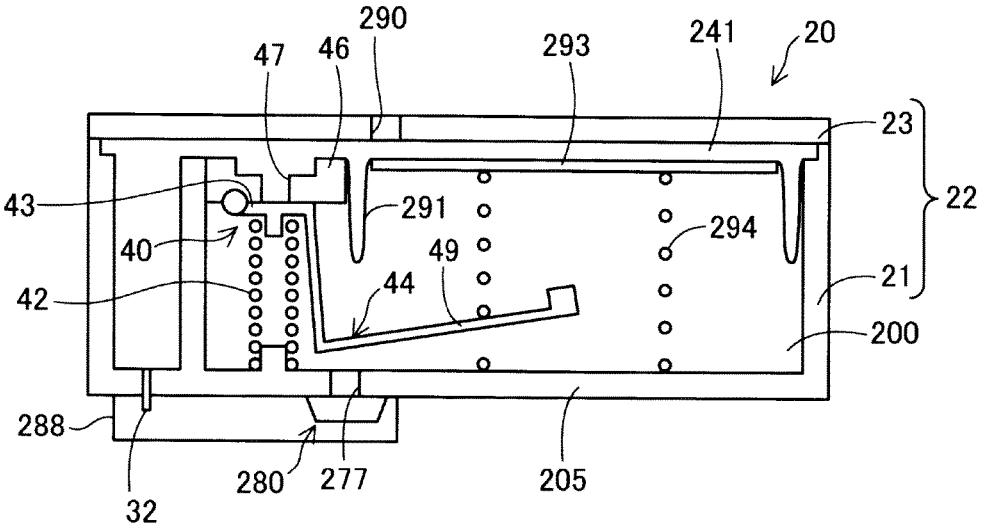
FIG. 15 is a schematic diagram illustrating an internal structure of the cartridge.
Figure 16:
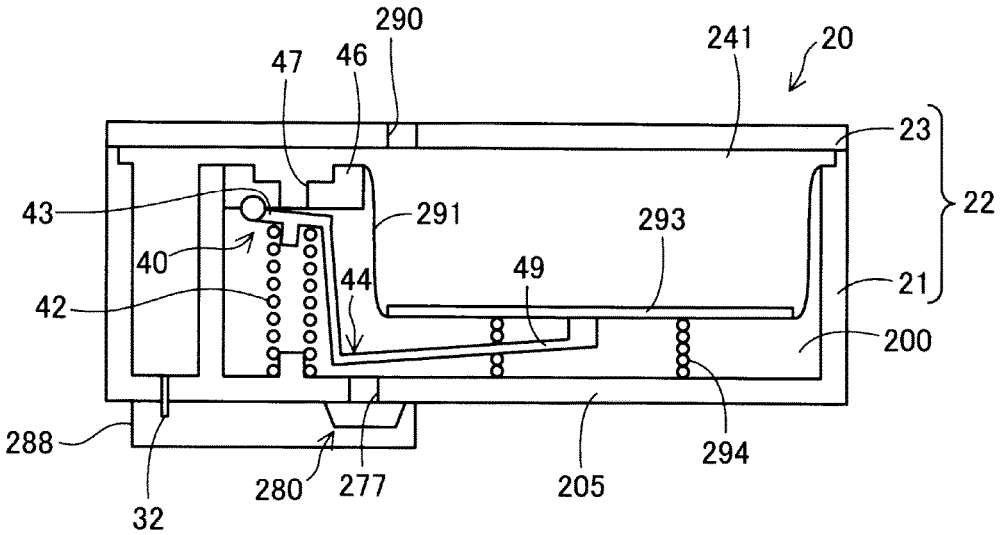
FIG. 16 is a schematic diagram illustrating an internal structure of the cartridge.
Figure 17:
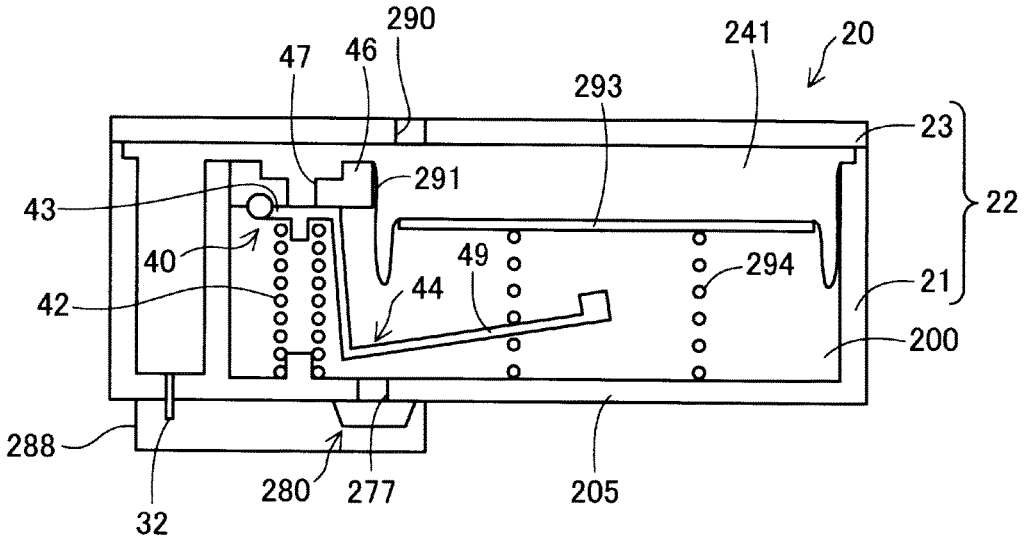
FIG. 17 is a schematic diagram illustrating an internal structure of the cartridge.

FIGS. 15 to 17 are schematic diagrams for illustrating an internal structure of the cartridge 20. As shown in FIG. 15, the outer shell 22 of the cartridge 20 has a body member 21 and a lid member 23. The body member 21 constitutes the first wall 201, the second wall 202, the third wall 203, the fourth wall 204, the fifth wall 205, and the seventh wall 207. The lid member 23 constitutes the sixth wall 206. As a result of the lid member 23 being attached so as to close the opening of the body member 21, an internal space is formed in the cartridge 20. The communication port 32 is provided in the body member 21. The vent 290 is provided in the lid member 23. Both the communication port 32 and the vent 290 are in communication with air. A sheet member 291, which is a flexible member, is located between the fifth wall 205 and the sixth wall 206 (lid member 23).

The cartridge 20 includes the liquid containing chamber 200. The liquid containing chamber 200 is partitioned by the body member 21 and the sheet member 291. That is to say, the ink is contained between the fifth wall 205 of the body member 21 and the sheet member 291. The liquid containing chamber 200 is in communication with the liquid supply portion 280 through the opening 277. The cartridge 20 also includes an air chamber 241. The air chamber 241 is a space formed between the lid member 23 and the sheet member 291. The air chamber 241 is in communication with the outside air through the vent 290 provided in the lid member 23. The communication port 32 is in communication with the air chamber 241.

A pressure receiving plate 293, which is a plate-shaped member, is arranged within the liquid containing chamber 200. One face of the pressure receiving plate 293 comes into contact with a face of the sheet member 291 on the liquid containing chamber 200 side. A coil spring 294 is arranged between the other face of the pressure receiving plate 293 (the face on the side in the −Y direction) and the fifth wall 205 in the liquid containing chamber 200. The coil spring 294 serves as a negative pressure generating mechanism for generating a predetermined negative pressure in the liquid containing chamber 200. The coil spring 294 biases the pressure receiving plate 293 from the fifth wall 205 toward the sixth wall 206. That is to say, the coil spring 294 biases the sheet member 291 in the direction in which the volume of the liquid containing chamber 200 expands, via the pressure receiving plate 293. Due to the biasing force of this coil spring 294, the pressure in the liquid containing chamber 200 is at a lower pressure than the atmospheric pressure (negative pressure). A target negative pressure value (degree) can be set by adjusting a spring constant of the coil spring 294.

In this embodiment, when viewed in a plan view in the direction from the fifth wall 205 toward the six wall 206, the coil spring 294 is a cylindrical spring whose diameter at a portion near the fifth wall 205 and diameter at a portion near the sixth wall 206 are the same. However, the shape of the coil spring 294 is not limited to this shape. The diameter thereof at a portion near the fifth wall 205 and the diameter at a portion near the sixth wall 206 may be different. Although this embodiment uses the coil spring 294 as the negative pressure generating mechanism, the negative pressure generating mechanism may be constituted by other spring members, such as a flat spring. If the negative pressure generating mechanism is constituted by a spring member such as the coil spring 294 or a flat spring, a desired negative pressure can be readily obtained.

The air is introduced into the liquid containing chamber 200 at a given timing via the vent 290, the air chamber 241, and the air introduction port 47. The air introduction port 47 is a communication hole through which the space (liquid containing chamber 200) between the fifth wall 205 and the sheet member 291 is in communication with the space (air chamber 241) between the sixth wall 206 and the sheet member 291. The cartridge 20 includes an air valve 40 for opening and closing this air introduction port 47. The air valve 40 includes a valve seat 46, a valve member 44, and a coil spring 42. The valve member 44 is pressed against the valve seat 46 by the coil spring 42, and closes the air introduction port 47, which is a through hole formed in the valve seat 46. The valve member 44 includes a valve portion 43, which is capable of opening and closing the air introduction port 47, and a lever portion 49 that abuts against the pressure receiving plate 293 to enable the valve portion 43 to move.

Operation of the cartridges 20 will be described below. When the cartridge 20 is in an initial state (unused state), the liquid containing chamber 200 is filled with ink. At this time, the pressure receiving plate 293 is located at a position closest to the lid member 23, as shown in FIG. 15.

When the ink in the liquid containing chamber 200 has been consumed and the pressure receiving plate 293 has approached the fifth wall 205, the pressure receiving plate 293 presses the lever portion 49 toward the fifth wall 205, as shown in FIG. 16. As a result, the valve portion 43 moves away from the air introduction port 47. That is to say, the valve member 44 enters an open state. Then, the outside air flows into the liquid containing chamber 200 through the vent 290, the air chamber 241, and the air introduction port 47. As a result, the volume of the liquid containing chamber 200 increases by the amount of air introduced, as shown in FIG. 17. Simultaneously, the negative pressure in the liquid containing chamber 200 decreases to approach the atmospheric pressure. Upon a certain amount of air being introduced into the liquid containing chamber 200, the pressure receiving plate 293 moves away from the lever portion 49. As a result, the valve portion 43 again closes the air introduction port 47. That is to say, the valve member 44 enters a closed state. In this manner, when the negative pressure in the liquid containing chamber 200 increases following the consumption of the ink in the liquid containing chamber 200, the valve member 44 temporarily enters the open state, thereby enabling the pressure in the liquid containing chamber 200 to be kept in an appropriate pressure range. For this reason, for example, it is possible to suppress the negative pressure in the liquid containing chamber 200 from excessively increasing and preventing the ink from being supplied from the liquid supply portion 280.

Figure 18:
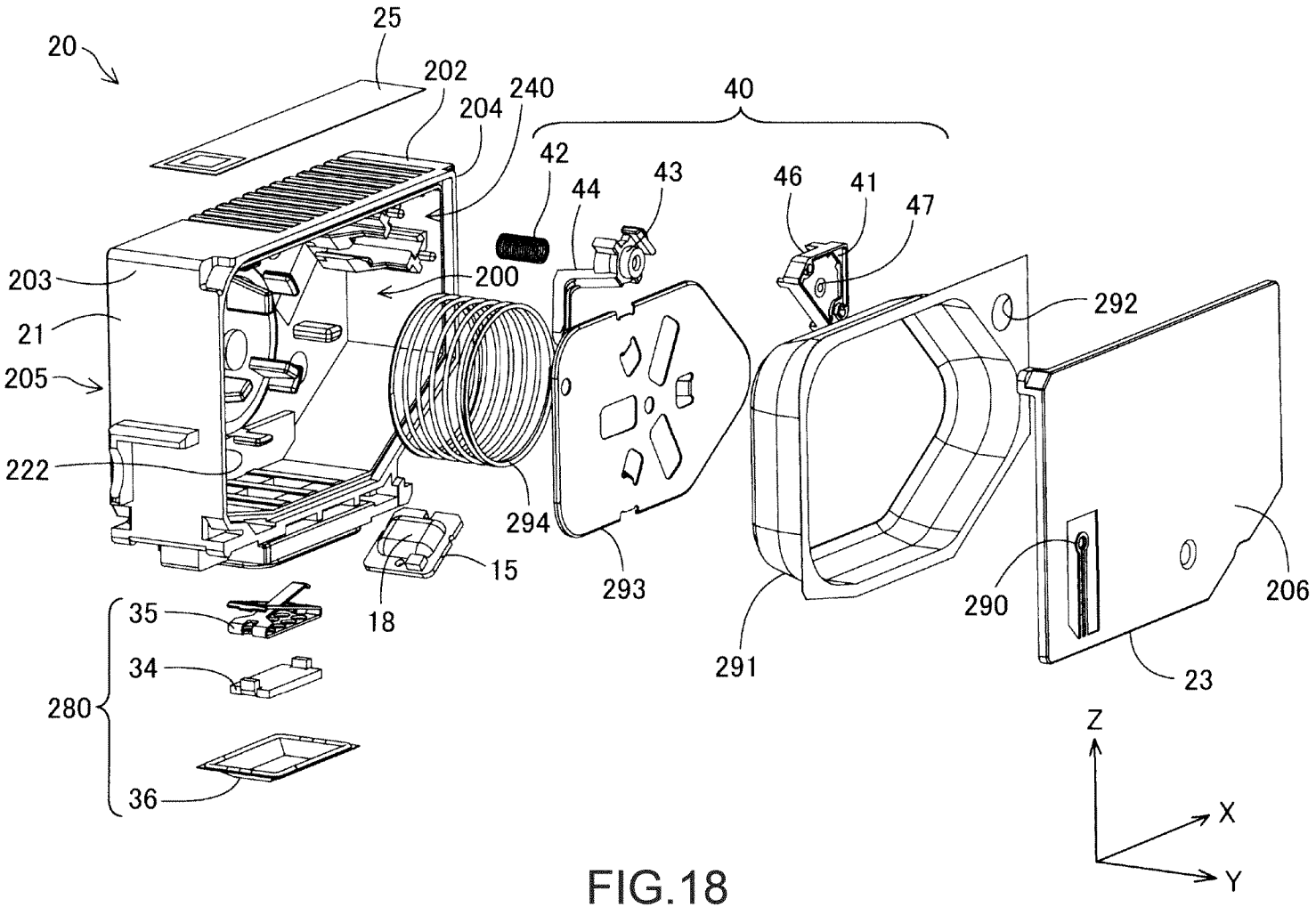
FIG. 18 is an exploded perspective view of the cartridge.

FIG. 18 is an exploded perspective view of the cartridge 20. The cartridge 20 includes the body member 21, the plate-shaped lid member 23, and the flexible sheet member 291. The body member 21 has a substantially rectangular-parallelepiped shape. The body member 21 has a recessed shape with an opening 222 on the side in the +Y direction. The sheet member 291 is adhered or welded to the body member 21, and demarcates the liquid containing chamber 200 together with the body member 21. That is to say, a portion of the peripheral wall of the liquid containing chamber 200 is formed by the sheet member 291. A through hole 292 for bringing the air chamber 241 into communication with the air introduction port 47 is formed in the sheet member 291.

The lid member 23 is attached to the body member 21 so as to cover the sheet member 291. The body member 21 and the lid member 23 are made of synthetic resin, such as polypropylene. The sheet member 291 is made of synthetic resin, such as a material that contains nylon and polypropylene.

The pressure receiving plate 293 is made of synthetic resin such as polypropylene, or metal such as stainless steel. The pressure receiving plate 293 is arranged so as to be in contact with the sheet member 291. The coil spring 294 is arranged in the liquid containing chamber 200. The coil spring 294 abuts against the pressure receiving plate 293 and a face of the body member 21 that opposes the pressure receiving plate 293. The pressure receiving plate 293 moves within the liquid containing chamber 200 as the ink in the liquid containing chamber 200 is consumed. The direction in which the pressure receiving plate 293 moves is a direction parallel to the Y direction.

The air valve 40 includes the coil spring 42, the valve member 44, and the valve seat 46. The valve seat 46 is contained in a corner portion 240 of the body member 21 at which the second wall 202 crosses the fourth wall 204, and is attached to the body member 21. The valve seat 46 is made of a synthetic resin such as polypropylene, for example. The valve seat 46 has a recessed portion. The sheet member 291 is airtightly stuck to an end face 41 of the valve sheet 46 that forms an opening of the recessed portion. The recessed portion of the valve seat 46 is in communication with the through hole 292 of the sheet member 291. The air introduction port 47, which penetrates to the back side of the valve seat 46, is formed at the bottom of the recessed portion of the valve seat 46.

The valve portion 43 of the valve member 44 is pressed against the valve seat 46 by the coil spring 42 to close the air introduction port 47. The pressure receiving plate 293 deforms and thus abuts against the lever portion 49 in the valve member 44. The valve member 44 is made of a synthetic resin, such as polypropylene, for example. Otherwise, the valve member 44 may be formed through double-molding using an elastic member, such as elastomer, and a synthetic resin, such as polypropylene.

A seal 25 is stuck to the outer surface of the second wall 202 of the body member 21 in some cases. The manufacturer of the cartridge 20, the model thereof, and the like are indicated on the seal 25, for example. The seal 25 may be stuck at any position. For example, the seal 25 may be stuck to any one of the second wall 202, the third wall 203, the fourth wall 204, the fifth wall 205, and the sixth wall 206. Otherwise, the seal 25 may be stuck over two or more walls. Otherwise, a plurality of seals may be stuck over two or more walls.

In FIG. 12, the length and width of the cartridge 20 are denoted as L1 and L2, respectively. In this embodiment, the length L1 of the cartridge 20 in the X direction, i.e. the distance L1 from the third wall 203 to the fourth wall 204 is about 50 mm. Also, in this embodiment, the width L2 of the cartridge 20 in the Y direction, i.e. the distance L2 from the fifth wall 205 to the sixth wall 206 is about 15 mm. In this embodiment, if four cartridges 20 are arranged, the entire width thereof exceeds the length of each cartridge 20. That is to say, in this embodiment, the length L1 and width L2 of the cartridge 20 satisfy the following condition (1).

$$L1<L2*4 \quad (1)$$

In this embodiment, the cartridges 20 are not arranged in the X direction, which is the main scanning direction, but are arranged in the Y direction, which is the sub-scanning direction. For this reason, even if four or more cartridges 20 are arranged and thus the entire width of these cartridges 20 exceeds the length of each cartridge 20, the size of the carriage 60 does not need to be increased in the X direction. Accordingly, the width of the printer 50 (length in the X direction) can be reduced. Note that the dimensions of each cartridge 20 are not limited to the aforementioned dimensions. If the total width of a plurality of cartridges 20 arranged is greater than the length of each cartridge 20, the width of the printer 50 (length in the X direction) can be reduced regardless of the number of cartridges 20.

Figure 19:
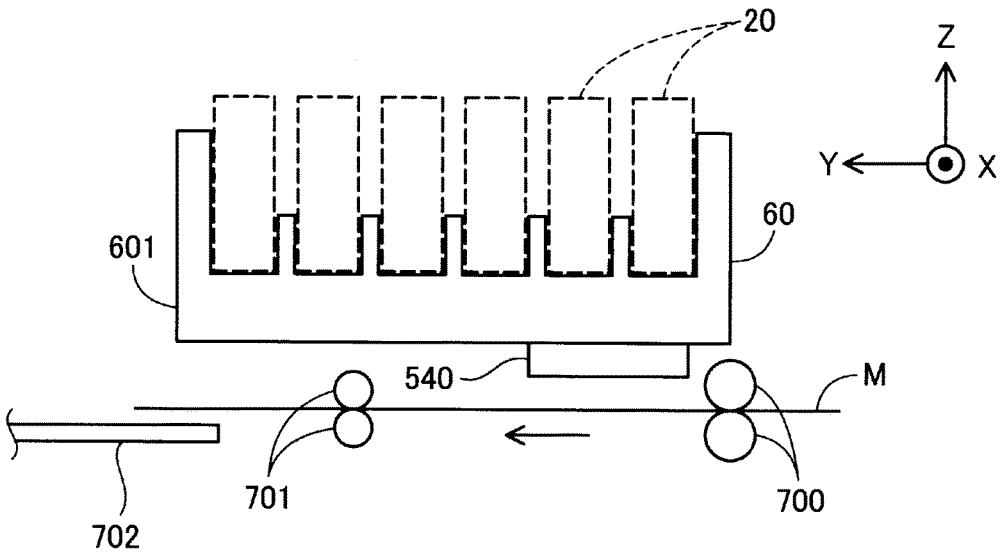
FIG. 19 is a schematic diagram depicting a positional relationship between a liquid ejection head, a supply roller, and a discharge roller.

FIG. 19 is a schematic diagram depicting a positional relationship between the liquid ejection head 540, supply rollers 700, and discharge rollers 701. The printer 50 contains the supply rollers 700 and the discharge rollers 701 for conveying a print medium M in the +Y direction. The supply rollers 700 are provided at a position in the carriage 60 further on the side in the −Y direction than the side in the +Y direction. On the other hand, the discharge rollers 701 are provided at a position in the carriage 60 further on the side in the +Y direction than the side in the −Y direction.

In this embodiment, the supply rollers 700 include a roller provided on the +Z side a roller provided on the −Z side, and hold the print medium M using these rollers. As a result of at least one of these rollers being driven by a motor, the print medium M is conveyed in the +Y direction. The print medium M conveyed by the supply rollers 700 is supplied to a position opposing the liquid ejection head 540. In this embodiment, the discharge rollers 701 also include a roller provided on the +Z side a roller provided on the −Z side, and hold the print medium M using these rollers. As a result of at least one of these rollers being driven by a motor, the print medium M that has been printed using the liquid ejection head 540 is conveyed in the +Y direction, and is discharged to a discharge tray 702. During printing, a front panel of the printer 50 is open, and the discharge tray 702 protrudes in the +Y direction from the inside of the printer 50.

The liquid ejection head 540, which is provided on the side in the −Z direction in the bottom 601 of the carriage 60, is provided at a position between the supply rollers 700 and the discharge rollers 701 in the Y direction. The liquid ejection head 540 is provided at a position closer to the supply rollers 700 than to the discharge rollers 701 in the Y direction. If the print medium M is supplied while tilting relative to the supply rollers 700, an error, particularly an error in the main scanning direction in the position on the print medium M at which the ink lands increases further on the downstream side (discharge side). However, in this embodiment, the liquid ejection head 540 is provided at a position closer to the supply rollers 700 for supplying the print medium M than to the discharge rollers 701 for discharging the print medium M. Accordingly, the accuracy of the position on the print medium M at which the ink lands can be improved.

In this embodiment, the liquid ejection head 540 is provided in the bottom 601 of the carriage 60 at a position in the carriage 60 further on the side in the −Y direction than on the side in the +Y direction. For this reason, a large space on the downstream side of the discharge rollers 701 can be secured in the printer 50. As a result, the size of the discharge tray 702 in the Y direction can be reduced. The space for installing the printer 50 in the Y direction can also be reduced.

Figure 20:
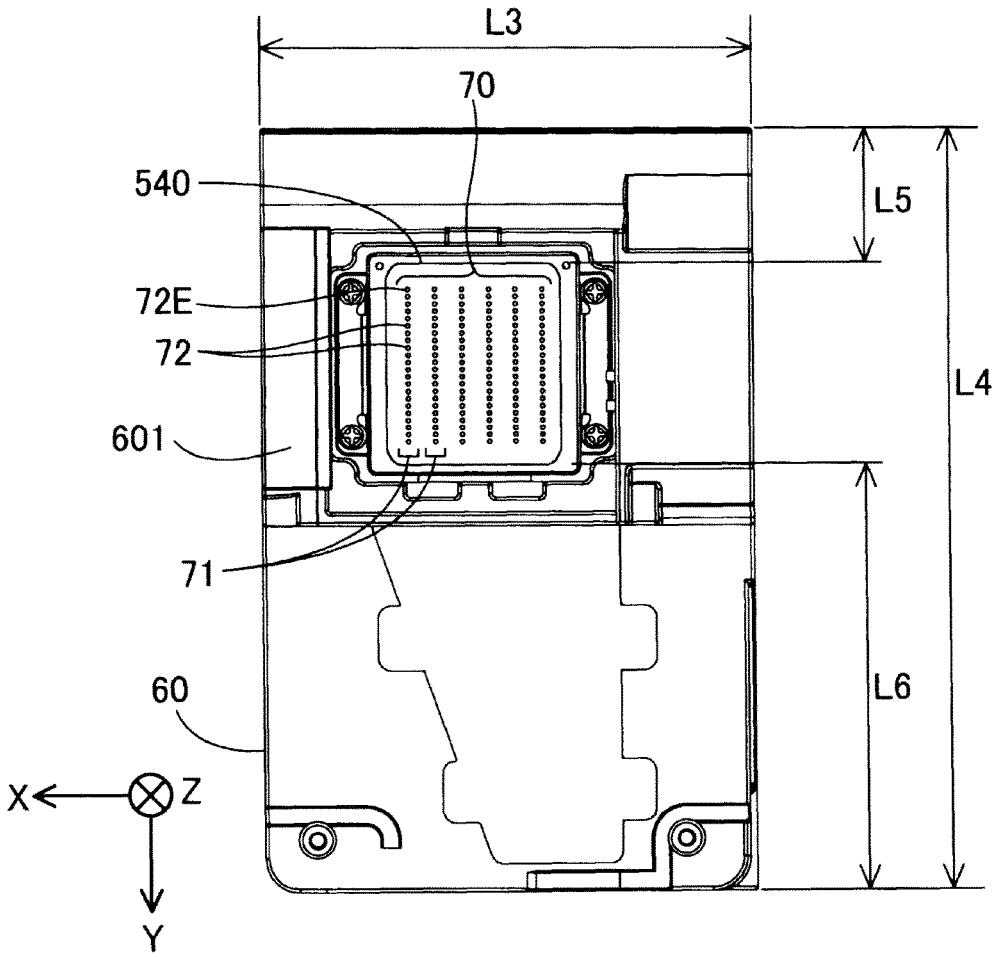
FIG. 20 shows a bottom of the carriage as viewed from a −Z direction.

FIG. 20 shows the bottom 601 of the carriage 60 as viewed from the −Z direction. The liquid ejection head 540 is provided in the bottom 601 of the carriage 60. The liquid ejection head 540 includes a nozzle group 70 for ejecting ink onto the print medium. The nozzle group 70 includes a plurality of nozzle rows 71. The nozzle rows 71 are each constituted by a plurality of nozzles 72 for ejecting one type of liquid supplied from one of the plurality of cartridges 20. A nozzle 72E shown in FIG. 20 is a nozzle located at the end on the side in the −Y direction in the nozzle group 70.

The plurality of nozzles 72 constituting each nozzle row 71 are arranged in the Y direction. The plurality of nozzle rows 71 are arranged in the X direction. Thus, in this embodiment, the plurality of nozzles 72 are arranged in the Y direction, and the plurality of nozzle rows 71 are arranged in the X direction. Accordingly, the size of the entire nozzle group 70 in the X direction can be reduced compared with the case where the plurality of nozzles 72 are arranged not parallel to the Y direction, or the case where the plurality of nozzle rows 71 are arranged obliquely relative to the X direction. As a result, the maximum width by which the carriage 60 can move in the X direction can be reduced, and the width of the printer 50 (length in the X direction) can be reduced. Note that each nozzle row 71 may be constituted by a plurality of nozzles 72 that are arranged in a houndstooth pattern in the Y direction.

As shown in FIG. 20, in this embodiment, the length L3 of the carriage 60 in the X direction is shorter than the length L4 of the carriage 60 in the Y direction. The distance L5 from the end of the liquid ejection head 540 in the −Y direction to the end of the carriage 60 in the −Y direction is shorter than the distance L6 from the end of the liquid ejection head 540 in the +Y direction to the end of the carriage 60 in the +Y direction. That is to say, in this embodiment, the following conditions (2) and (3) are satisfied. In this embodiment, since the distance L5 and distance L6 satisfy the condition (3), the liquid ejection head 540 can be readily brought close to the supply rollers 700 (see FIG. 19). Accordingly, the accuracy of the position on the print medium at which the ink lands can be improved. In addition, the space for discharging paper in the printer 50 can also be increased.

$$L3<L4 \quad (2)$$

$$L5<L6 \quad (3)$$

Figure 21:
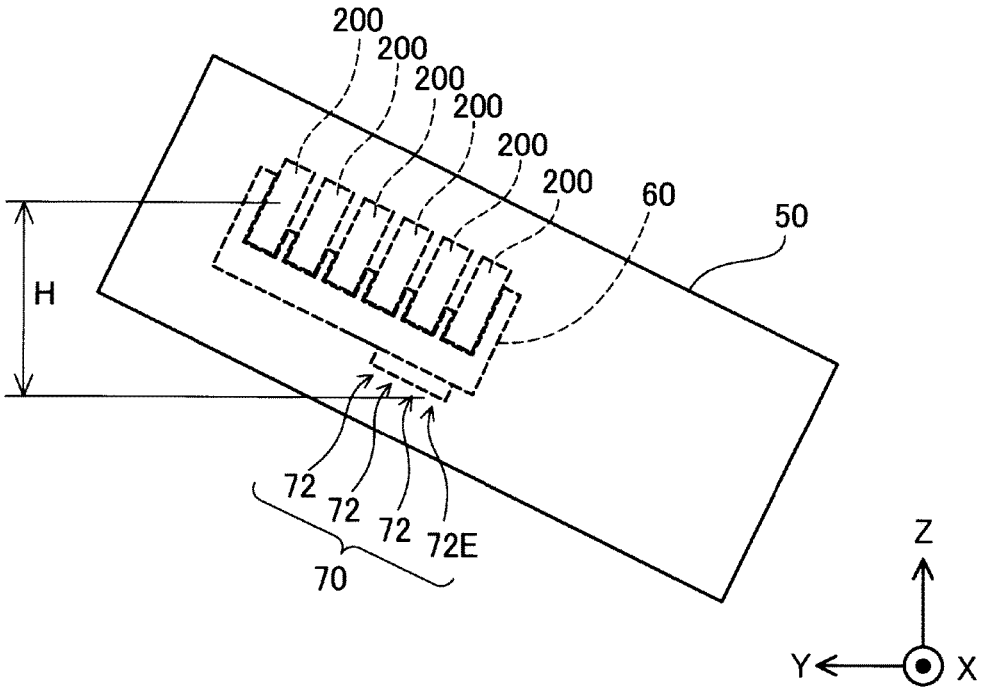
FIG. 21 is a diagram illustrating a negative pressure to be generated in a liquid containing chamber.

FIG. 21 is a diagram illustrating the negative pressure to be generated in the liquid containing chamber 200 in the cartridge 20. In this embodiment, the negative pressure to be generated in the liquid containing chamber 200 in each cartridge 20 is determined so that the pressure of the ink applied to the nozzle 72E located at the end on the side in the −Y direction in the nozzle group 70 is lower than the atmospheric pressure when the printer 50 is caused to assume an orientation in which the printer 50 is tilted with the side of the printer 50 in the −Y direction lower, relative to the gravity direction (−Z direction), than the side in the +Y direction. For example, if the pressure of the ink applied to the nozzle 72E is 0.9 atm, since the liquid containing chamber 200 is located at a position higher than the nozzle 72E in the vertical direction (Z direction), the pressure in the liquid containing chamber 200 is lower than a hydrostatic pressure of 0.9 atm, which corresponds to the height H of the liquid containing chamber 200. In other words, the pressure in the liquid containing chamber 200 is a negative pressure that is greater than 0.9 atm. If the pressure in the liquid containing chamber 200 is set to such a pressure (negative pressure), it is possible to suppress leakage of the ink from the nozzles 72 when the printer 50 is tilted.

Regarding this negative pressure, it is favorable that the pressure of the ink applied to the nozzle 72E located at the end on the side in the −Y direction in the nozzle group 70 is lower than the atmospheric pressure when the printer 50 is caused to assume an orientation in which the side of the printer 50 in the −Y direction is lower, relative to the gravity direction, than the side on the +Y direction before the liquid in the liquid containing chamber 200 starts to be consumed, i.e. with a new cartridge 20 attached to the carriage 60, for example. If the pressure in the liquid containing chamber 200 is set to such a negative pressure, leakage of the ink from the nozzle 72 can be suppressed when the printer 50 is tilted, regardless of the amount of the ink in the liquid containing chamber 200. For this reason, leakage of the ink from the nozzles 72 can be more effectively suppressed. In a state where the printer 50 is tilted to the greatest degree in an orientation in which the side of the printer 50 in the −Y direction is lower, relative to the gravity direction, than the side in the +Y direction, the printer 50 assumes an orientation in which the print medium discharging direction is a vertically upward direction.

The aforementioned negative pressure may be set to a common value for the cartridges 20. Otherwise, a value for each cartridge 20 may be set corresponding to the position on the carriage 60 at which this cartridge 20 is attached. For example, in the case of setting the negative pressure to a common value, it is favorable to set a negative pressure at which the ink in the cartridge 20 located at the end in the +Y direction does not leak. In the case of setting the negative pressure in accordance with the position on the carriage 60 at which each cartridge 20 is attached, it is favorable to set a greater negative pressure for a cartridge 20 located further in the +Y direction. This is because, in an orientation in which the side of the printer 50 in the −Y direction is lower, relative to the gravity direction, than the side in the +Y direction, a cartridge 20 located further in the +Y direction is at a higher position than the position of the nozzle 72E, and the ink is more likely to leak.

Note that, regarding the aforementioned negative pressure, it is favorable that the pressure of the ink applied to the nozzle 72E located at the end on the side in the −Y direction in the nozzle group 70 is set to be lower than the atmospheric pressure in an orientation in which the side of the printer 50 in the −Y direction is lower, relative to the gravity direction, than the side in the +Y direction, and in which the printer 50 is tilted by 30 degrees or more relative to a horizontal surface, preferably is tilted by 45 degrees or more, more preferably is tilted by 60 degrees or more, or still more preferably is tilted by 90 degrees.

B. Modifications

First Modification

In the above embodiment, the plurality of nozzles 72 constituting each nozzle row 71 are arranged in the Y direction. The plurality of nozzle rows 71 are arranged in the X direction. In contrast, the nozzles 72 may be arranged in a direction that is not parallel to the Y direction, i.e. a direction oblique to the Y direction. The plurality of nozzle rows 71 may be arranged in a direction oblique to the X direction.

Second Modification

In the above embodiment, the negative pressure to be generated in the liquid containing chamber 200 is determined so that the liquid pressure applied to the nozzle 72E located at the end in the −Y direction in the nozzle group 70 is lower than the atmospheric pressure when the printer 50 is caused to assume an orientation in which the printer 50 is tilted with the side of the printer 50 in the −Y direction lower, relative to the gravity direction (−Z direction), than the side in the +Y direction. However, the negative pressure to be generated in the liquid containing chamber 200 is not limited to such a pressure. For example, a negative pressure for each cartridge 20 may be determined so that the liquid pressure applied to each nozzle 72 is lower than the atmospheric pressure when the printer 50 is in the use state.

Third Modification

In the above embodiment, the coil spring 294 is used as the negative pressure generating mechanism. In contrast, the negative pressure generating mechanism may be constituted by foam, for example. In this case, the foam is arranged in the liquid containing chamber 200, and a negative pressure is generated using a suction force of the foam. The foam may be a porous foam such as a sponge, or may be foam that is made of a fibrous material. If the negative pressure generating mechanism is constituted by foam, a desired negative pressure can be readily obtained.

Fourth Modification

Although the cartridge 20 according to the above embodiment is of a so-called semi-sealed type, the invention may also be applied to other types of cartridges. For example, the invention is also applicable to a cartridge of a type in which the liquid containing chamber 200 is always in communication with the outside, and a cartridge of a type in which the liquid containing chamber 200 is always sealed.

Fifth Modification

In the above embodiment, the liquid supply portion 280 includes the foam 34 and the flat spring 35, as shown in FIG. 14. In contrast, the liquid supply portion 280 may have any structure as long as the ink can be supplied from the liquid containing chamber 200 to the liquid introducing portion 640 of the printer 50. For example, either one of the foam 34 and the flat spring 35 may be omitted. At least one of the cartridge filter 36, the foam 34, and the flat spring 35 may be replaced with one or more foams.

Sixth Modification

In the above embodiment, each cartridge 20 is constituted by seven walls. In contrast, the number of walls for constituting each cartridge 20 is not limited to seven, as long as a space that is capable of containing the ink is formed. For example, each cartridge 20 may be constituted by six walls or less, or may be constituted by eight walls or more. For example, each cartridge 20 may be constituted by a sphere, or one or more curved walls. Otherwise, each cartridge 20 may be constituted by combining curved walls and plate-shaped walls.

Seventh Modification

The invention is applicable not only to printers and ink cartridges thereof, but also to any kind of liquid ejection apparatus that ejects liquids other than ink, and cartridges to be used in those liquid ejection apparatuses. For example, the invention is applicable as a cartridge to be used in various liquid ejection apparatuses such as those listed below:

(1) image recording apparatuses such as a facsimile apparatus;

(2) color material ejection apparatuses used to manufacture color filters for image display apparatuses such as a liquid crystal display;

(3) electrode material ejection apparatuses used to form electrodes for organic EL (Electro Luminescence) displays, field emission displays (FED), or the like;

(4) liquid ejection apparatuses that eject liquid containing biological organic matter used to manufacture biochips;

(5) sample ejection apparatuses serving as precision pipettes;

(6) lubricating oil ejection apparatuses;

(7) resin solution ejection apparatuses;

(8) liquid ejection apparatuses that eject lubricating oil pinpoint to precision machines such as a watch and a camera;

(9) liquid ejection apparatuses that eject transparent resin solution, such as UV-cured resin solution, onto substrates in order to form micro-hemispherical lenses (optical lenses) used in optical communication elements and the like;

(10) liquid ejection apparatuses that eject acid or alkaline etchant in order to etch substrates and the like; and

(11) liquid consuming apparatuses including liquid consuming heads for discharging a very small amount of any other kinds of droplet.

Note that "droplet" refers to a state of the liquid discharged from a liquid ejection apparatus, and includes droplets having a granular shape, a tear-drop shape, and a shape having a thread-like trailing end. The "liquid" mentioned here need only be any kind of material that can be consumed by a liquid ejection apparatus. For example, the "liquid" need only be a material in a state where a substance is in a liquid phase, and a liquid material having a high or low viscosity, sol, gel water, and other liquid materials such as an inorganic solvent, organic solvent, solution, liquid resin, and liquid metal (metallic melt) are also included in the "liquid". The "liquid" is not limited to being a single-state substance, and also includes particles of a functional material made from solid matter, such as pigment or metal particles, that are dissolved, dispersed, or mixed in a solvent, or the like. Representative examples of the liquid include ink such as that described in the above embodiment, liquid crystal, or the like. Here, the "ink" encompasses general water-based ink and oil-based ink, as well as various types of liquid compositions such as gel ink and hot melt ink.

The invention is not limited to the above embodiment and modifications, and can be implemented by various configurations without departing from the gist thereof. For example, the technical features in the embodiment and modifications that correspond to the technical features in the modes described in the summary of the invention can be replaced or combined as appropriate in order to solve some or all of the problems described above, or in order to achieve some or all of the above-described effects. The technical features that are not described as essential in this specification may be removed as appropriate.

What is claimed is:

1. A liquid ejection apparatus, assuming that three orthogonal directions thereof are an X direction, a Y direction, and a Z direction, and a positive Y direction and a negative Y direction respectively are a +Y direction and a −Y direction, and a positive Z direction and a negative Z direction respectively are a +Z direction a −Z direction, the apparatus comprising:

a liquid ejection head having a nozzle group for ejecting liquid onto a medium;

a carriage that has a bottom formed parallel to the X direction and the Y direction and moves in the X direction;

a supply roller that is provided at a position closer to a side of the carriage in the −Y direction than to a side thereof in the +Y direction, and conveys the medium in the +Y direction; and a discharge roller that is provided at a position closer to the side of the carriage in the +Y direction than to the side thereof in the −Y direction, and conveys the medium in the +Y direction, wherein a plurality of cartridge slots configured to receive a corresponding number of cartridges, including at least three or more cartridges each having different ink types, are provided in the bottom of the carriage on a side in the +Z direction, each of the plurality of cartridge slots are arranged relative to each other in the Y direction, and the liquid ejection head is provided in the bottom of the carriage on a side in the −Z direction, at a position between the supply roller and the discharge roller, the position being closer to the supply roller than to the discharge roller.

2. The liquid ejection apparatus according to claim 1, wherein the plurality of cartridge slots are substantially equal in width to each other.

3. The liquid ejection apparatus according to claim 1, wherein the nozzle group includes a plurality of nozzle rows, the nozzle rows are constituted by a plurality of nozzles that eject one type of liquid supplied from one of the cartridges, the plurality of nozzles constituting the nozzle rows are arranged in the Y direction, and the plurality of nozzle rows are arranged in the X direction.

4. A cartridge configured for attachment to the liquid ejection apparatus according to claim 3, comprising:

a liquid containing chamber; and a negative pressure generating mechanism that generates a predetermined negative pressure in the liquid containing chamber, wherein the negative pressure is set so that a liquid pressure applied to a nozzle located at an end in the −Y direction in the nozzle group is lower than the atmospheric pressure when the liquid ejection apparatus is caused to assume an orientation in which a side of the liquid ejection apparatus in the −Y direction is lower, relative to the gravity direction, than a side thereof in the +Y direction.

5. A cartridge configured for attachment to the liquid ejection apparatus according to claim 1, comprising:

a liquid containing chamber; and a negative pressure generating mechanism that generates a predetermined negative pressure in the liquid containing chamber, wherein the negative pressure is set so that a liquid pressure applied to a nozzle located at an end in the −Y direction in the nozzle group is lower than the atmospheric pressure when the liquid ejection apparatus is caused to assume an orientation in which a side of the liquid ejection apparatus in the −Y direction is lower, relative to the gravity direction, than a side thereof in the +Y direction.

6. The cartridge according to claim 5, wherein the negative pressure is set so that a liquid pressure applied to a nozzle located at an end in the −Y direction in the nozzle group is lower than the atmospheric pressure when the liquid ejection apparatus is caused to assume an orientation in which a side of the liquid ejection apparatus in the −Y direction is lower, relative to the gravity direction, than a side thereof on the +Y direction before the liquid in the liquid containing chamber starts to be consumed.

7. The cartridge according to claim 5, wherein the negative pressure generating mechanism is constituted by a spring or foam.

* * * * *